US006808389B1

(12) United States Patent
Glidden

(10) Patent No.: US 6,808,389 B1
(45) Date of Patent: Oct. 26, 2004

(54) APPARATUS FOR IGNITING COMBUSTIBLE FUEL

(75) Inventor: James A. Glidden, Saginaw, MI (US)

(73) Assignee: Banner Engineering & Sales Inc., Saginaw, MI (US)

( * ) Notice: Subject to any disclaimer, the term of this patent is extended or adjusted under 35 U.S.C. 154(b) by 0 days.

(21) Appl. No.: 10/455,913

(22) Filed: Jun. 6, 2003

(51) Int. Cl.[7] ..... F23Q 3/00
(52) U.S. Cl. ..... 431/264; 431/256; 431/257
(58) Field of Search ..... 431/265, 264, 431/263, 258, 256, 257; 313/141, 143, 118, 326

(56) References Cited

U.S. PATENT DOCUMENTS 1,189,509 A 3/1916 Urban
3,172,460 A 3/1965 Temple et al.
4,177,034 A * 12/1979 Jones ..... 431/264
4,307,603 A * 12/1981 Dobler et al. ..... 73/35.08
4,325,690 A * 4/1982 Hayes ..... 431/258
4,466,789 A 8/1984 Riehl
4,541,797 A 9/1985 Riehl
4,949,705 A 8/1990 Smith
5,033,454 A 7/1991 Smith
5,347,982 A 9/1994 Binzer et al.
5,752,817 A * 5/1998 Ahmady ..... 431/264

* cited by examiner

*Primary Examiner*—Jiping Lu
(74) *Attorney, Agent, or Firm*—John K. McCulloch

(57) ABSTRACT

Apparatus for igniting combustible fuel discharged from an outlet in a burner tube comprises a dielectric support within which are an ignition electrode and a ground electrode projecting beyond the support and which are spaced from one another a distance to form a gap which may be traversed by sparks generated by the ignition electrode. A fuel concentrator plate is carried by the ground electrode and partially embraces the ignition electrode adjacent the gap. The electrode support is mounted directly on the burner tube in a position to enable the concentrator plate to intercept fuel discharged from the outlet and concentrate the fuel in the zone of the gap.

20 Claims, 2 Drawing Sheets

APPARATUS FOR IGNITING COMBUSTIBLE FUEL

This invention relates to apparatus especially adapted for use in ovens of commercial bakeries for igniting a combustible fuel to produce a flame and for monitoring the presence of the flame.

BACKGROUND OF THE INVENTION

It is conventional in the baking industry to utilize gas fired bakery ovens which define an enclosure through which baked goods are conveyed by chain or other conveyors which extend longitudinally of the oven. Extending transversely of the path traversed by the conveyor is a plurality of burner tubes which are spaced apart from one another so as to enable the interior of the oven to be heated to desired temperature levels.

Each burner is coupled to a source of combustible fuel, such as natural or propane gas, and each burner is provided with a ribbon or other fuel outlet through which the gas may pass for combustion. At a selected point along the length of each burner is positioned a fuel igniter by means of which fuel flowing through the burner outlet may be ignited.

At one time in the past the fuel igniter was constituted by an electrode positioned adjacent a burner tube at ground potential but spaced from the latter by a gap. The electrode was coupled to an electrical energy source which functioned to generate sufficient energy to enable sparks to jump the gap between the electrode and the burner tube. In the earlier embodiments of such apparatus the sparks were generated continuously, even when the flame was present. The continuous sparking was to ensure that whatever fuel was discharged from the burner would most likely be ignited.

The continuous sparking concept has significant disadvantages. For example, passing sparks continuously through a flame causes the formation of solid carbon "whiskers" which may bridge the spark gap and short the spark. In addition, maintenance of a proper spark gap between the igniter electrode and the burner is difficult due to the expansion and contraction of the burner tubes as they become heated and cooled. Further, heat generated from the constant sparks results in electrode wear and enlargement of the spark gap which leads eventually to loss of the spark.

In those instances in which there is no spark and the burner fails to light, loss of oven heat results, thereby adversely affecting the baked products. In the event of the failure of a burner to light, there is a possibility of creating an unsafe condition due to the introduction of unburned gas into the oven.

Various proposals have been made heretofore to overcome these problems, but none has been able to eliminate the basic flaws of a constant sparking ignition system.

The difficulties with the constant sparking ignition system long have been recognized. One proposal to overcome some of the problems is the provision of solid state, electronic spark ignition/flame rectification proving modules to replace the continuous spark ignition system. The ignition/flame rectification modules provide ignition, thereby establishing a flame, sense the presence of the flame, and discontinue sparking during the presence of the flame. In a system using these modules the presence of a flame disables the generation of sparks, thereby overcoming many of the problems associated with continuous sparking. These modules also function in the absence of the flame at an individual burner to shut off the flow of fuel to the affected burner, thus enhancing safety.

Although the ignition/flame rectification proving module represents a significant advantage over the continuous sparking system, the ignition electrode of such module still remains a problem because of the difficulty in providing and maintaining a proper spark gap between the ignition electrode and the burner.

A principal object of the invention is to provide apparatus for igniting combustible fuel to generate a flame and which overcomes the objectionable characteristics of currently available ignition systems.

SUMMARY OF THE INVENTION

Apparatus constructed in accordance with the preferred embodiment of the invention comprises an ignition system which is compatible with the ignition/flame rectification proving modules referred to above, but which eliminates or minimizes some of the problems associated with maintaining the proper spark gap of the spark ignition system. Such apparatus comprises an elongate support formed of dielectric material and through which extends an electrically conductive electrode by means of which sparks may be generated. Also extending through the dielectric support is an electrically conductive electrode terminating at one end in an electrically conductive plate which is positioned adjacent the end of the ignition electrode, but spaced therefrom a distance corresponding to a desired width spark gap. The free end of the plate is bent so as partially to embrace the ignition electrode and to extend somewhat beyond the latter. The bending of the plate enables fuel issuing from the burner tube to be concentrated at the spark gap and the extension of the plate beyond the ignition electrode provides assurance that the ignition electrode will not engage the burner tube, which normally is at ground potential, and short the spark.

The ignition electrode and the ground electrode are secured in the support against rotary movement relative to the support and to one another.

THE DRAWINGS

Apparatus constructed in accordance with the invention is illustrated in the accompanying drawings wherein.

THE PREFERRED EMBODIMENT

Figure 1:
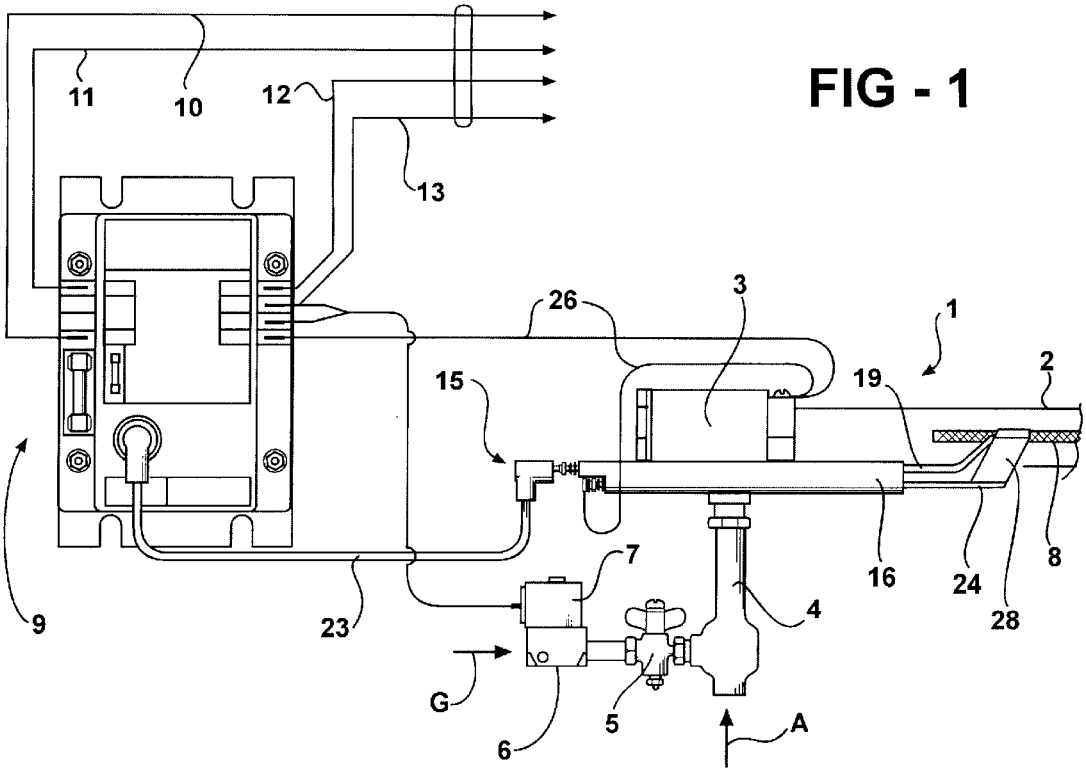
FIG. 1 is a fragmentary, elevational, schematic view of the apparatus.

Apparatus constructed in accordance with the invention is adapted for use in a commercial baking oven (not shown) of the kind having a plurality of burner tubes arranged transversely of the path taken by the bakery products through the oven and spaced from one another longitudinally along such path. One burner tube is shown at 1 and comprises a cylinder 2, typically formed of steel, joined at one end to a burner head 3 to which a fuel/air mixer 4 is coupled. Combustible fuel, such as gas, is supplied to the mixer 4 via a gas cock 5. A valve 6 actuated by a solenoid 7 controls the flow of gas to the burner tube 2, as is conventional. The burner tube 2 has a longitudinally extending fuel outlet or port 8. The solenoid 7 is electrically connected to terminals of an ignition sensor proving unit (ISPU) of the kind supplied by Joseph M. Day Company, Saginaw, Michigan and designated Model ISPU-2.

The unit 9 is connected by suitable wiring 10 to a voltage source and by other wiring 11 to a neutral source. Other wiring 12 and 13 connects the unit 9 to a burner failure indicator (not shown) and to a burner "on" indicator (not shown), respectively.

The parts 1–13 are conventional and form no part of the invention other than the manner in which they cooperate with the latter. For convenience the oven with which the apparatus described above is not shown in the drawings. It will be understood, however, that the parts 3–13 will be located externally of the oven in a conventional manner such as is illustrated in Temple et al U.S. Pat. No. 3,172,460.

An igniter assembly according to the invention is designated generally by the reference character 15 and comprises an elongate body 16 formed of dielectric ceramic material, such as alumina or high density porcelain, capable of withstanding heat generated by combustion of the fuel. The body is provided with two parallel, spaced apart bores 17 and 18 each of which extends the full length of the body. Extending through the bore 17 and projecting beyond both ends of the latter is an ignition electrode 19 formed of an electrically conductive, high chromium/nickel content material such as 310 stainless steel. At a position spaced from the adjacent end of the body 16 the electrode 19 is bent to form an obliquely extending section 20 and then bent again to form a tip section 21 having a longitudinal axis parallel to, but spaced from, that of the electrode section 19. At the opposite end of the electrode 19 are fittings 22 for connecting such electrode by a suitable cable 23 to the unit 9, as is conventional in the ignition/flame rectification proving system referred to above.

Extending completely through the bore 18 in the support 16 is a ground electrode 24 formed of electrically conductive material such as 310 stainless steel. One end of the electrode 24 is provided with fittings 25 coupled by wiring 26 to the unit 9 in a conventional manner. The opposite end of the electrode 24 protrudes beyond the adjacent end of the support 16 and is secured to a flag-like, fuel concentrator 27 comprising a flat blade or plate 28 formed of electrically conductive material such as 310 stainless steel. The plate is welded or otherwise suitably secured at one end to the free end of the ground electrode 24. Between its opposite ends the plate 28 is bent as at 29 to form a flange 30 which projects toward, but is spaced from, the tip 21 of the igniter electrode. The spacing between the flange 30 and the electrode tip section 21 forms a gap 32 of appropriate width to enable sparks to traverse such gap. The plate 28 also is bendable adjacent the electrode 24 as is shown at 31 for a purpose presently to be explained.

Since the electrodes 19 and 24 usually are cylindrical it is desirable to restrain rotation of each of the electrodes relative to each other and to the support 16. In the preferred embodiment the free end of the support 16 has a pair of transversely extending recesses 33 and 34. A restraining pin 35 extends through the electrode 19 and is accommodated in the recess 33. A similar pin 36 extends through the electrode 24 and is accommodated in the recess 34.

The spacing between the electrodes 19 and 24 and the density of the material from which the support 16 is formed are such as to ensure the absence of arcing between those portions of the electrodes which lie within the support or between those portions of the electrode which extend beyond the ends of the support. The pins 35 and 36 are positioned within the respective recesses 33 and 34 to preclude any relative rotation between the electrodes and the support.

To ensure retention of the pins 35 and 36 in their respective recesses notwithstanding thermal expansion and contraction of the electrodes, each electrode is encircled by a flat end compression spring 35*a* which reacts between the adjacent face of the body 16 and the associated fitting 22 and 25, thereby biasing each restraining pin to a position in which it is seated in its recess.

Figure 3:
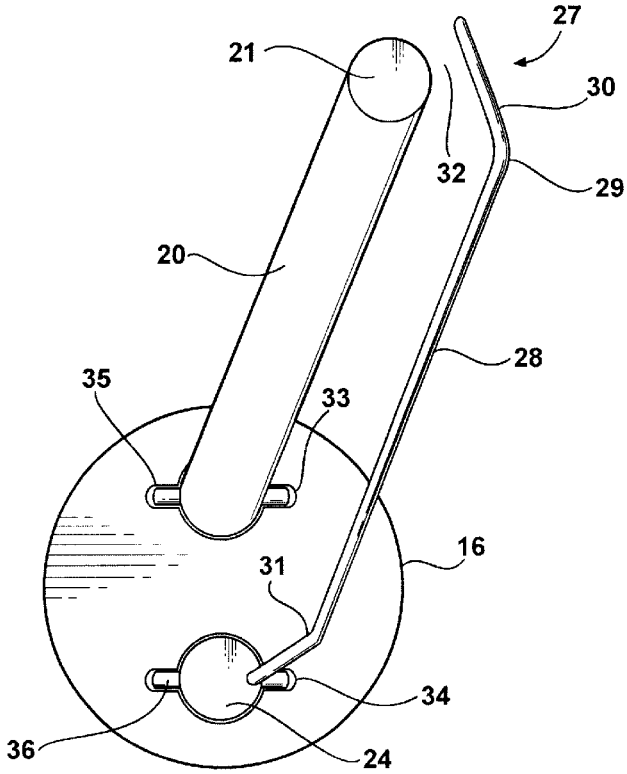
FIG. 3 is an end elevational view of the apparatus.
Figure 2:
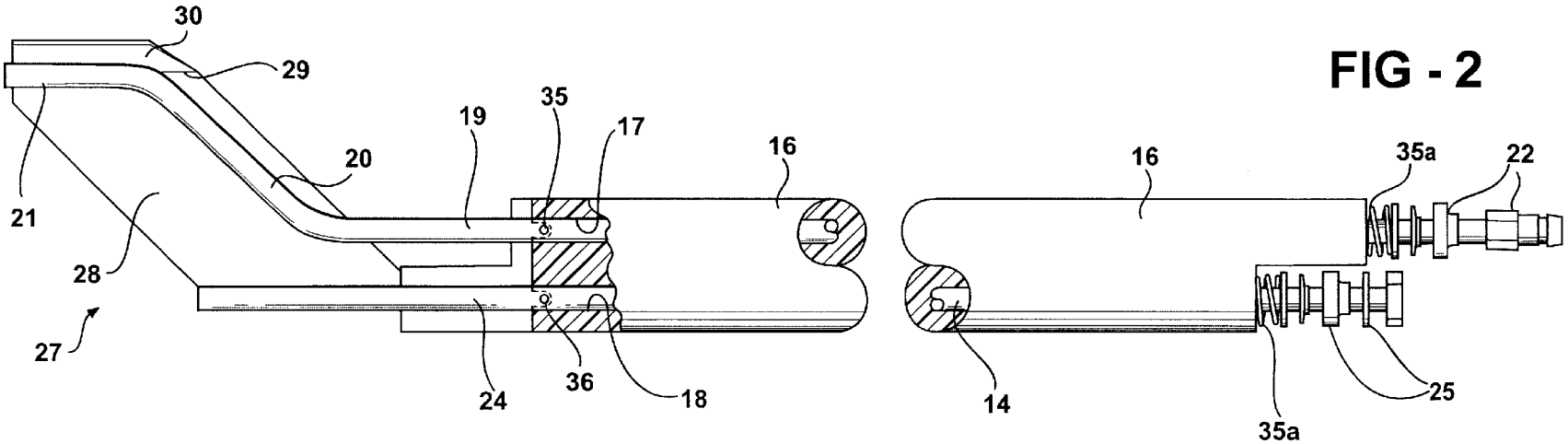
FIG. 2 is an enlarged, fragmentary, partly elevational and partly sectional view of the apparatus.

To condition the apparatus for operation, the electrodes 19 and 24 are fitted into the support 16 so as to occupy the positions indicated in FIGS. 2 and 3. The fittings 22 and 25 then may be coupled to the appropriate terminals of the ISPU unit 9.

The assembled support and electrodes may be mounted on the associated burner tube 2 by means of one or more brackets 37 each of which has a terminal end 38 fixed to the tube 2 by one or more bolts 39. Each bracket 37 also has an intermediate section 40 which is bent to form a socket 41 for the accommodation of the support 16. The bracket 37 may be formed of such material as to to assure retention of the support 16 in the socket.

Figure 5:
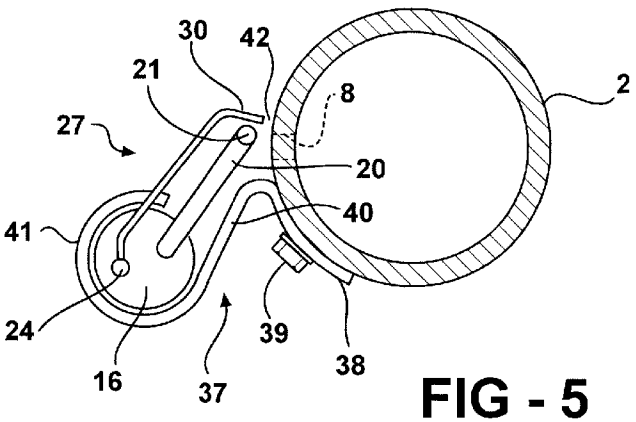
FIGS. 4 and 5 are sectional views illustrating the apparatus attached to a burner tube in two different positions of adjustment.

Following assembly of the support 16 and the burner tube 2 the bracket 37 and the concentrator plate 28 may be adjusted, by bending, to the positions shown in FIG. 5 wherein the free end 30 of the plate 28 is spaced from the surface of the burner tube 2 by a gap 42. Preferably, the adjustment of the plate 28 is such that the free end 30 of the latter partially embraces and projects beyond the free end of the electrode tip 21, as is shown in FIG. 5. Bending of the plate at the zone 31 facilitates the positioning of the free end of the plate. During these adjustments the spark gap 32 is maintained.

Installation of the support 16 and its associated parts alongside a burner tube 2 as shown in FIG. 5 is such that fuel discharged through an outlet 8 flows toward the plate 28 and past the tip 21 of the igniter electrode 19. The ISPU unit 9 will be activated so as to cause sparks to be generated and traverse the spark gap 32. Because the concentrator plate 27 partially embraces the electrode tip 21 fuel impinging on and intercepted by the plate 27 will be concentrated at the gap 32 thereby ensuring the presence of fuel in the immediate zone at which the sparks traverse the gap 32. Consequently, the ignition of the combustible fuel is assured thereby creating a flame along the length of the burner tube outlet 8. Once the flame is established it will be sensed by the unit 9, thereby discontinuing the generation of sparks as is conventional. However, fuel issuing from the outlet 8 still will be able to impinge upon the collector plate 27 so that, in the event the flame is extinguished, sparks once again will be generated enabling ignition of the fuel.

Figure 4:
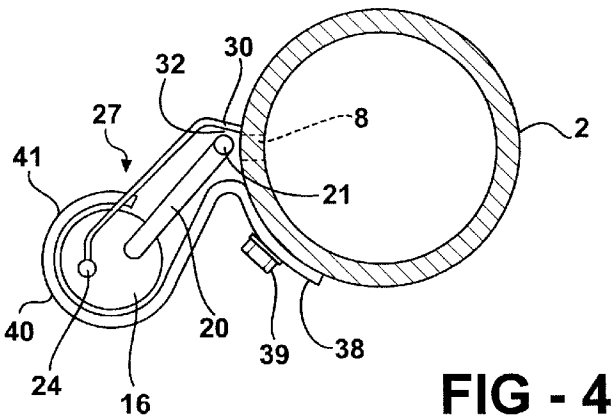

Each burner tube conventionally has a length depending upon the width of the oven in which it is installed, and such length may be as great as 10 or more feet. Since the temperature within the oven before and during baking operations may differ by several hundred degrees, a burner tube sometimes distorts due to thermal stresses. The effect of such distortion with respect to the position of the igniter apparatus is minimized because the latter is mounted directly on the associated burner 2. However, if the distortion is such that the tip 30 of the plate 28 bears against the burner tube 2, as is shown in FIG. 4, the spark gap 32 nevertheless will be maintained thereby avoiding shorting of the spark path. It is for this reason that the plate 28 is bendable at the zones 29 and 31 so as to enable the tip of the concentrator plate to extend somewhat beyond the electrode tip section 21.

The disclosed embodiment is representative of a presently preferred form of the invention, but is intended to be illustrative rather than definitive thereof. The invention is defined in the claims.

I claim:

1. Apparatus for igniting combustible fuel emitted from a fuel outlet in a burner, said apparatus comprising a support formed of electrically insulating material capable of withstanding heat generated by combustion of said fuel; an electrically conductive ignition electrode carried by said support and operable to generate sparks, one end of said electrode projecting beyond one end of said support; an electrically conductive ground electrode carried by said support in spaced relation to said ignition electrode and projecting beyond said one end of said support; and an electrically conductive concentrator carried by said ground electrode in a position adjacent, but spaced by a gap from said one end of said ignition electrode, the spacing between said one end of said ignition electrode and said concentrator being such as to enable sparks generated by said ignition electrode to traverse said gap and thereby ignite fuel adjacent said gap.

2. The apparatus according to claim 1 wherein said support is formed from ceramic material.

3. The apparatus according to claim 2 wherein said ceramic material is porcelain.

4. The apparatus according to claim 1 wherein each of said electrodes comprises an elongate, cylindrical rod.

5. The apparatus according to claim 4 including means for restraining rotation of each of said electrodes relative to said support.

6. The apparatus according to claim 5 wherein said means for restraining rotation comprises a recess in said support and a pin carried by said electrode and extending laterally thereof into said recess.

7. The apparatus according to claim 6 including spring means acting on each said electrode in such direction as to maintain the associated pin in the associated recess.

8. The apparatus according to claim 1 wherein said concentrator comprises a blade of such area as to enable fuel discharged from said outlet to be intercepted by said blade.

9. The apparatus according to claim 8 wherein said blade is configured to concentrate at said gap fuel intercepted by said blade.

10. The apparatus according to claim 1 including an electrical energy source coupled to said ignition electrode and being operable to generate sparks at said gap.

11. The apparatus according to claim 1 wherein said ignition electrode extends through an opening in said support and said ground electrode extends through another opening in said support, said openings being parallel to and spaced apart.

12. Apparatus for igniting combustible gas discharged through an outlet in a burner, said apparatus comprising a support formed of electrically insulating material capable of withstanding heat generated by combustion of said gas; an electrically conductive ignition electrode extending through said support and projecting beyond one end thereof; an electrically conductive ground electrode extending through said support in spaced relation to said ignition electrode and projecting beyond said one end of said support; electrically conductive concentrator means carried by one of said electrodes and spaced from the other of said electrodes by a gap of such width as to enable a spark to traverse said gap; and means for mounting said support in such position as to locate said gap adjacent said outlet, said concentrator means being so positioned that gas discharged through said outlet is intercepted by said concentrator means thereby effecting concentration of said gas adjacent said gap.

13. The apparatus according to claim 12 wherein said concentrator means comprises a plate secured at one edge thereof to said other of said electrodes and projecting from said other of said electrodes a distance sufficient to extend beyond said one of said electrodes.

14. The apparatus according to claim 13 wherein said plate has a free edge opposite said one edge, said plate being bent between said edges to embrace said one of said electrodes adjacent said gap.

15. The apparatus according to claim 12 wherein said support is formed of porcelain of such density as to preclude arcing between those portions of said electrodes within said support.

16. The apparatus according to claim 12 including restraining means reacting between said support and at least one of said electrodes for preventing relative rotation thereof.

17. The apparatus according to claim 12 including restraining means reacting between said support and each of said electrodes for preventing relative rotation thereof.

18. The apparatus according to claim 16 wherein said restraining means comprises a pin extending laterally of said one of said electrodes and seated in a recess in said support.

19. The apparatus according to claim 18 including biasing means acting on said one of said electrodes and urging the latter in such direction as to maintain said pin seated in said recess.

20. The apparatus according to claim 12 wherein said concentrator means partially embraces and extends past said other electrode.

* * * * *